US008083526B2

(12) United States Patent
Long

(10) Patent No.: US 8,083,526 B2
(45) Date of Patent: Dec. 27, 2011

(54) SOCKET CONNECTOR WITH GROUND SHIELDS BETWEEN ADJACENT SIGNAL CONTACTS

(75) Inventor: Richard J. Long, Columbia, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/705,381

(22) Filed: Feb. 12, 2010

(65) Prior Publication Data

US 2011/0201234 A1 Aug. 18, 2011

(51) Int. Cl.
*H01R 12/00* (2006.01)

(52) U.S. Cl. ..... 439/60; 439/637

(58) Field of Classification Search ..... 439/60, 439/633, 637, 607.07, 607.05, 608, 630
See application file for complete search history.

(56) References Cited

U.S. PATENT DOCUMENTS 5,389,000 A * 2/1995 DiViesti et al. ..... 439/157
5,662,485 A * 9/1997 Yip et al. ..... 439/157
5,813,883 A * 9/1998 Lin ..... 439/637
5,853,303 A * 12/1998 Brunker et al. ..... 439/637
6,129,555 A * 10/2000 Daikuhara et al. ..... 439/60
6,464,537 B1 * 10/2002 Letourneau et al. ..... 439/607.14
6,767,252 B2 * 7/2004 McGrath et al. ..... 439/637
7,278,886 B2 10/2007 Cohen et al.
7,775,839 B1 * 8/2010 Okuyama et al. ..... 439/733.1
2002/0019170 A1 * 2/2002 Hassanzadeh et al. ..... 439/630
2007/0111554 A1 * 5/2007 Nishizaw et al. ..... 439/60
2007/0155245 A1 * 7/2007 Tsai ..... 439/637
2010/0178808 A1 * 7/2010 Vrenna et al. ..... 439/637

* cited by examiner

*Primary Examiner* — Tulsidas C Patel
*Assistant Examiner* — Harshad Patel

(57) ABSTRACT

A socket connector is provided for mating with a mating connector having a printed circuit. The socket connector includes a housing having a socket. The socket is configured to receive a mating edge of the printed circuit of the mating connector therein. Signal contacts are held by the housing. The signal contacts include mating interfaces arranged in a row within the socket of the housing. Electrically conductive ground shields are held by the housing. The ground shields extend from mating ends to mounting ends. The mating ends of the ground shields extend between adjacent signal contacts. The ground shields include shield slots extending into the mating ends. The shield slots of the ground shields are configured to receive the mating edge of the printed circuit of the mating connector therein to electrically connect the ground shields to the printed circuit.

20 Claims, 8 Drawing Sheets

SOCKET CONNECTOR WITH GROUND SHIELDS BETWEEN ADJACENT SIGNAL CONTACTS

BACKGROUND OF THE INVENTION

The subject matter described and/or illustrated herein relates generally to electrical connectors, and more particularly, to socket connectors that mate with mating connectors having printed circuits.

Computers and servers use numerous types of electronic modules, such as processor and memory modules (e.g. Dynamic Random Access Memory (DRAM), Synchronous Dynamic Random Access Memory (SDRAM), or Extended Data Out Random Access Memory (EDO RAM), and the like). The memory modules are produced in a number of formats such as, for example, Single In-line Memory Modules (SIMM's), Dual In-line Memory Modules (DIMM's), Small Outline DIMM's (SODIMM's), Fully Buffered DIMM's, and the like. The electronic modules may be installed in one or more socket connectors mounted on a motherboard or other system board.

Electronic modules often include a printed circuit having a mating edge that is received within a socket of the socket connector. The mating edge provides an interface between the electronic module and one or more rows of electrical contacts that extend within the socket of the socket connector. The printed circuit includes contact pads arranged along the mating edge on one or more sides of the printed circuit. For example, the printed circuit sometimes includes contacts pads arranged along the mating edge on two opposite sides of the printed circuit. The socket connector includes a pair of opposite rows of electrical contacts extending within the socket. When the mating edge of the printed circuit is received within the socket, the electrical contacts of each row of the socket connector engage the contact pads on a corresponding one of the sides of the printed circuit.

Because of the ongoing trend toward smaller electronic packages, adjacent electrical contacts within the same row of the socket connector are arranged relatively close together. Similarly, adjacent contact pads on the same side of the printed circuit are arranged relatively close together. The relatively close spacing between adjacent electrical contacts and adjacent contact pads that transmit signals may cause crosstalk, interference, noise, and/or the like between the adjacent contacts and between the adjacent pads. For example, the electrical contacts and the contact pads are sometimes arranged in differential signal pairs. The relatively close spacing between adjacent differential signal pairs may cause crosstalk, interference, noise, and/or the like therebetween. Such crosstalk, interference, noise, and/or the like may degrade signal performance. Ground shields are used in some electrical connectors to shield adjacent differential signal pairs from crosstalk, interference, noise, and/or the like. But, because of the limited amount of space within the socket of the socket connector, it may be difficult to isolate adjacent electrical contacts within the same row with an effective ground shield. Similarly, because of the limited amount of space along the mating edge of the printed circuit, it may be difficult to isolate adjacent contact pads on the same side of the printed circuit.

BRIEF DESCRIPTION OF THE INVENTION

In one embodiment, a socket connector is provided for mating with a mating connector having a printed circuit. The socket connector includes a housing having a socket. The socket is configured to receive a mating edge of the printed circuit of the mating connector therein. Signal contacts are held by the housing. The signal contacts include mating interfaces arranged in a row within the socket of the housing. Electrically conductive ground shields are held by the housing. The ground shields extend from mating ends to mounting ends. The mating ends of the ground shields extend between adjacent signal contacts. The ground shields include shield slots extending into the mating ends. The shield slots of the ground shields are configured to receive the mating edge of the printed circuit of the mating connector therein to electrically connect the ground shields to the printed circuit.

In another embodiment, an electrical connector assembly includes a printed circuit having a side that extends from a mating edge to an opposite edge. The side includes signal contacts arranged along the mating edge. The side of the printed circuit is configured to mate with a mating connector at the mating edge. The printed circuit includes a board slot extending a length into the mating edge. The board slot extends between adjacent signal contacts. The assembly includes the mating connector, which includes an electrically conductive ground shield extending from a mating end to a mounting end. The ground shield includes a shield slot extending into the mating end. The shield slot of the ground shield is interlocked with the board slot of the printed circuit such that the ground shield is received within the board slot and the printed circuit is received within the shield slot.

In another embodiment, an electrical connector assembly includes a socket connector having a housing that includes a socket. Signal contacts are held by the housing. The signal contacts include mating interfaces arranged in a row within the socket of the housing. Electrically conductive ground shields are held by the housing. The ground shields extend from mating ends to mounting ends. The mating ends of the ground shields extend between adjacent signal contacts. The ground shields include shield slots extending into the mating ends. The assembly includes a mating connector including a printed circuit having a side that extends from a mating edge to an opposite edge. The side includes signal pads arranged along the mating edge. The printed circuit includes a board slot extending a length into the mating edge. The board slot extends between adjacent signal pads. The mating edge of the printed circuit is received within the socket of the housing and the ground shields are interlocked with the board slots of the printed circuit such that the ground shields are received within the board slots and the printed circuit is received within the shield slots.

DETAILED DESCRIPTION OF THE INVENTION

Figure 1:
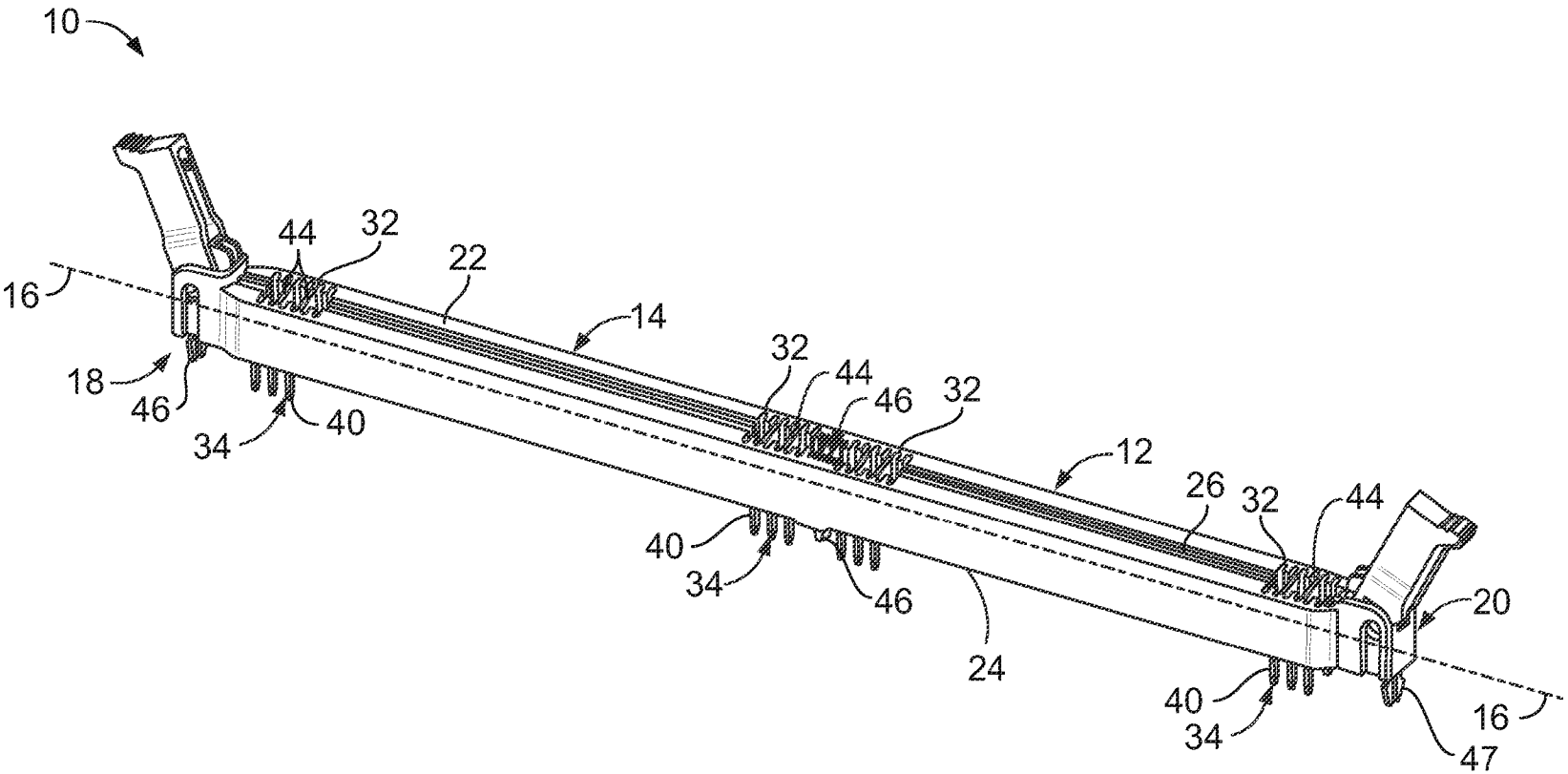
FIG. 1 is a perspective view of an exemplary embodiment of a socket connector.
Figure 2:
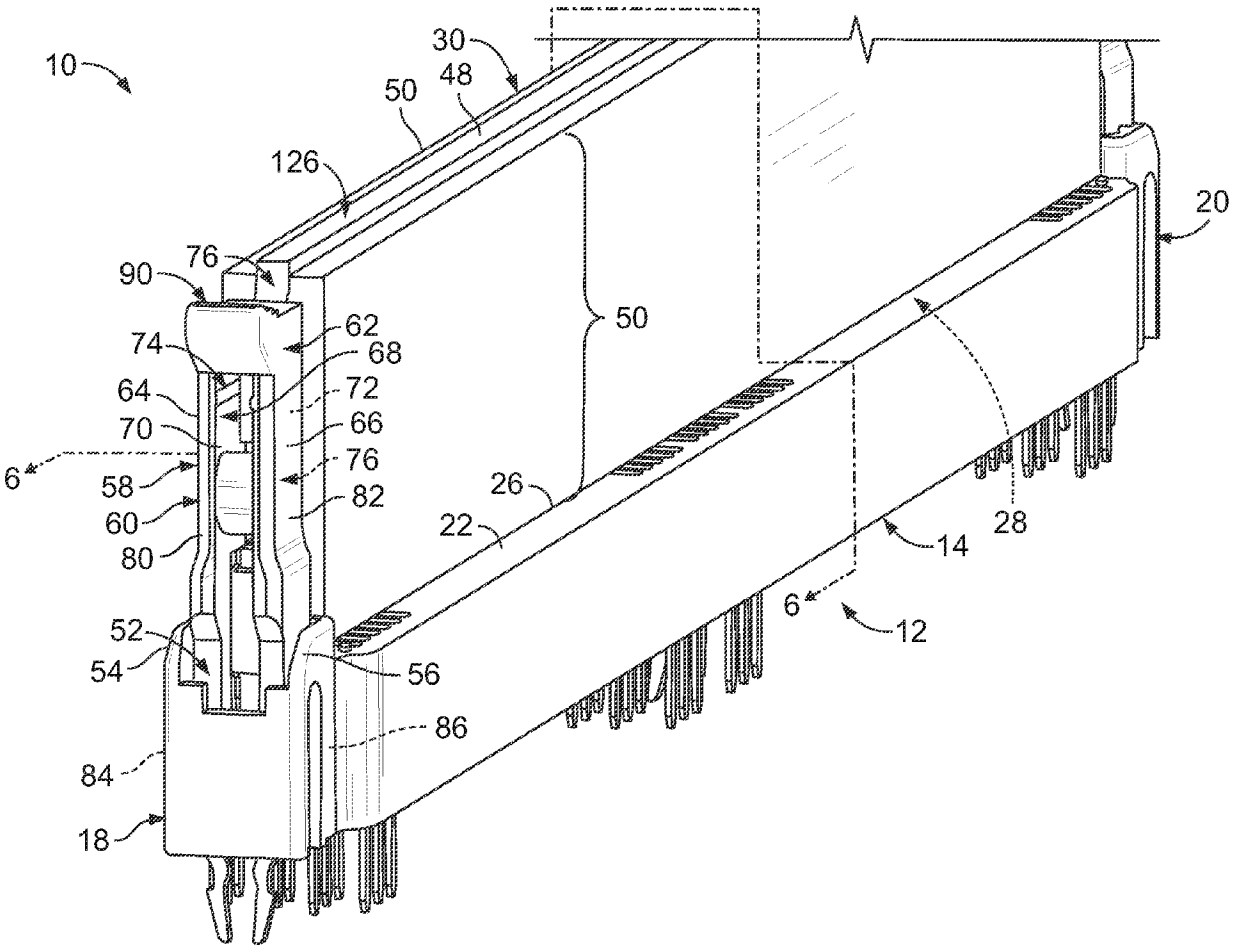
FIG. 2 is a partial perspective view of the socket connector shown in FIG. 1 with an exemplary electronic module installed thereon.

FIG. 1 is a perspective view of an exemplary embodiment of a socket connector 10. The socket connector 10 includes a housing 12 having a dielectric body 14 that extends along a central longitudinal axis 16 from an end 18 to an opposite end 20. The body 14 has a mating face 22 and a mounting face 24. The body 14 includes a socket 26 that is configured to receive a mating edge 28 (FIGS. 2, 3, 6, and 7) of an electronic module 30 (FIGS. 2 and 6). The housing body 14 includes a plurality of openings 32 that each fluidly communicate with the socket 26 and extend through the housing body 14 from the mating face 22 to the mounting face 24. Each opening 32 holds a portion of one or more electrical contacts 34 therein. Each electrical contact 34 includes a mating segment 38 (FIG. 5) and a mounting segment 40. The mating segments 38 extend into the socket 26 to electrically engage contact pads 42 (FIGS. 3, 6, and 7) on the electronic module 30 when the electronic module 30 is installed on the socket connector 10. The mounting segments 40 extend from the mounting face 24 of the housing body 14 and are configured to electrically connect the socket connector 10 to a motherboard (not shown) to enable the connection of the electronic module 30 to the motherboard.

As will be described in more detail below, electrically conductive ground shields 44 extend within the socket 26 between at least some adjacent electrical contacts 34. In the exemplary embodiment, the ground shields 44 extend between adjacent differential signal pairs of the electrical contacts 34.

Optionally, a key 46 may be provided at an off-center position in the socket 26 for reception within a notch (not shown) in the electronic module 30 to assure that the electronic module 30 is properly aligned with respect to the socket connector 10. One or more board locks 47 may optionally be provided to mechanically connect the socket connector 10 to the motherboard.

FIG. 2 is a perspective view of the socket connector 10 with an exemplary electronic module 30 installed thereon. A combination of the socket connector 10 and the electronic module 30 may be referred to herein as an "electrical connector assembly". The socket connector 10 and the electronic module 30 may each be referred to herein as a "mating connector". The electronic module 30 includes a printed circuit 48 having the mating edge 28. As used herein, the term "printed circuit" is intended to mean any electric circuit in which the electrical conductors have been printed or otherwise deposited in predetermined patterns on an insulating substrate. The printed circuit 48 includes exemplary electrical components generally represented at 50. Each of the electrical components may be any type of electrical component, whether active or passive. Examples of active electrical components include, but are not limited to, processors, amplifiers, and/or the like. Examples of passive electrical components include, but are not limited to, memories, resistors, capacitors, inductors, diodes, and/or the like. The housing ends 18 and 20 are substantially identical and therefore only the housing end 18 is described in detail. The housing end 18 includes a cavity 52 between opposed towers 54 and 56 that extend outwardly at the mating face 22 of the housing body 14. An extractor 58 is received in the cavity 52. The extractor 58 is pivotably connected to the housing end 18 for retaining the electronic module 30 on the housing body 14 and for extracting the electronic module 30 from the housing body 14. Specifically, the extractor 58 extends outwardly between the towers 54 and 56 and is pivotable between an open position (FIG. 1) for receiving the electronic module 30 within the socket 26 and a closed position (FIG. 2) for retaining the electronic module 30.

The extractor 58 includes a pair of opposite sides 60 and 62 that each engages the electronic module 30. Specifically, each of the sides 60 and 62 includes a side wall 64 and 66, respectively. The side walls 64 and 66 are spaced apart from one another such that an extractor slot 68 is defined therebetween. The extractor slot 68 is in communication with the socket 26 in the housing body 14. The extractor slot 68 receives the mating edge 28 of the printed circuit 48 of the electronic module 30. Opposite interior surfaces 70 and 72 of the side walls 64 and 66, respectively, include ribs 74 that engage an edge 76 of the printed circuit 48 of the electronic module 30 to stabilize the electronic module 30. Optionally, a beveled forward edge (not shown) on the ribs 74 provides guidance for facilitating entry of the edge 76 of the electronic module 30 into the extractor slot 68. The extractor 58 may include a latch element (not shown) that engages a notch (not shown) in the edge 76 of the printed circuit 48 of the electronic module 30 to facilitate retaining the electronic module 30 on the housing body 14. Opposite outer surfaces 80 and 82 of the side walls 64 and 66, respectively, may include a projection (not shown) that communicates with a retention receptacle (not shown) on inner surfaces 84 and 86 of the towers 54 and 56, respectively, to facilitate holding the extractor 58 in the closed position. A foot (not shown) of the extractor 58 engages an edge surface 88 (FIGS. 3, 6, and 7) of the mating edge 28 of the electronic module 30 to lift the electronic module 30 upward when the extractor 58 is opened to assist in the extraction of the electronic module 30 from the housing body 14. The extractor 58 may optionally include a thumb pad 90 for moving the extractor 58 between the open and closed positions.

Figure 3:
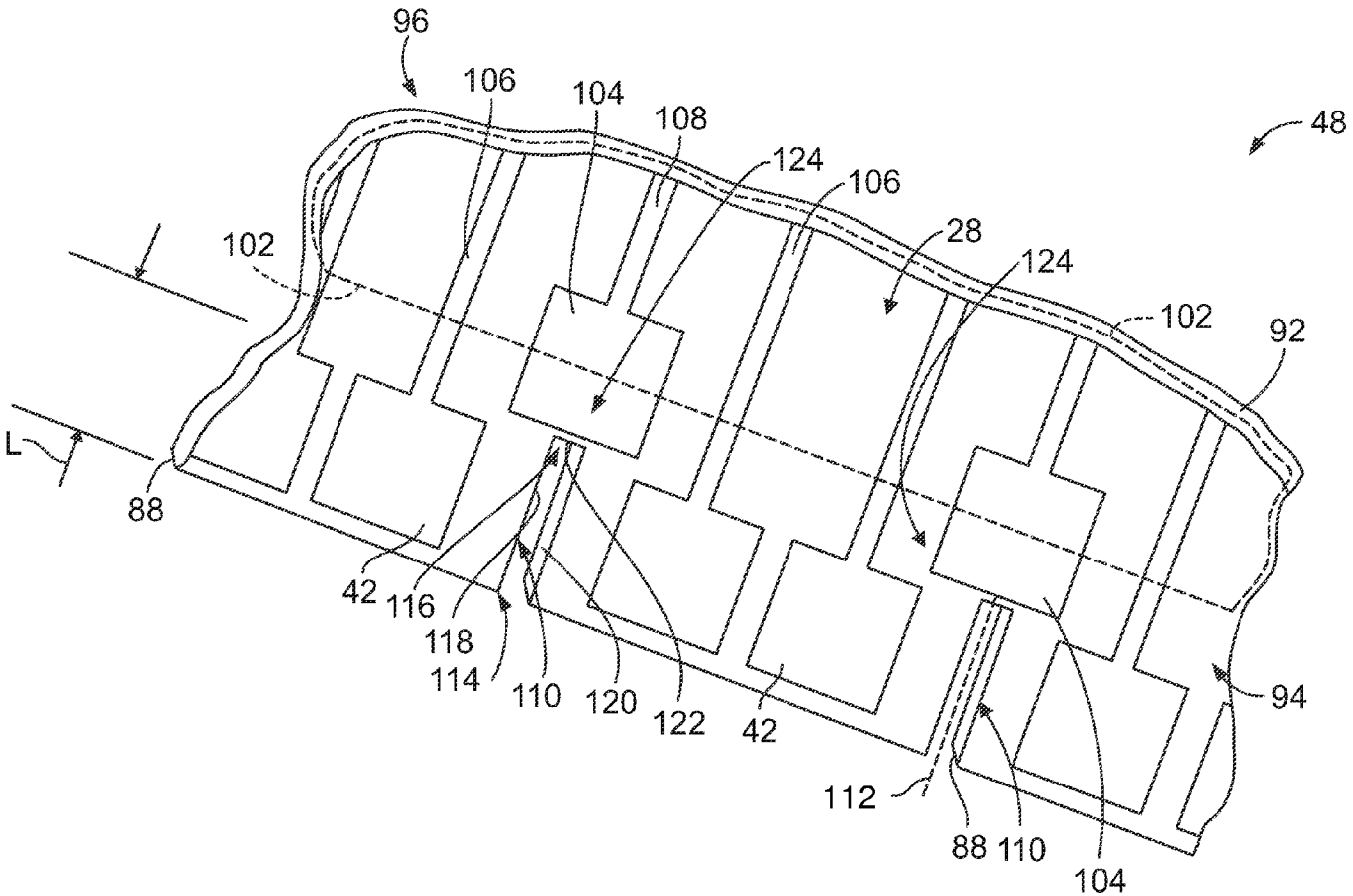
FIG. 3 is a perspective view of a portion of an exemplary embodiment of a printed circuit of the electronic module shown in FIG. 2.
Figure 7:
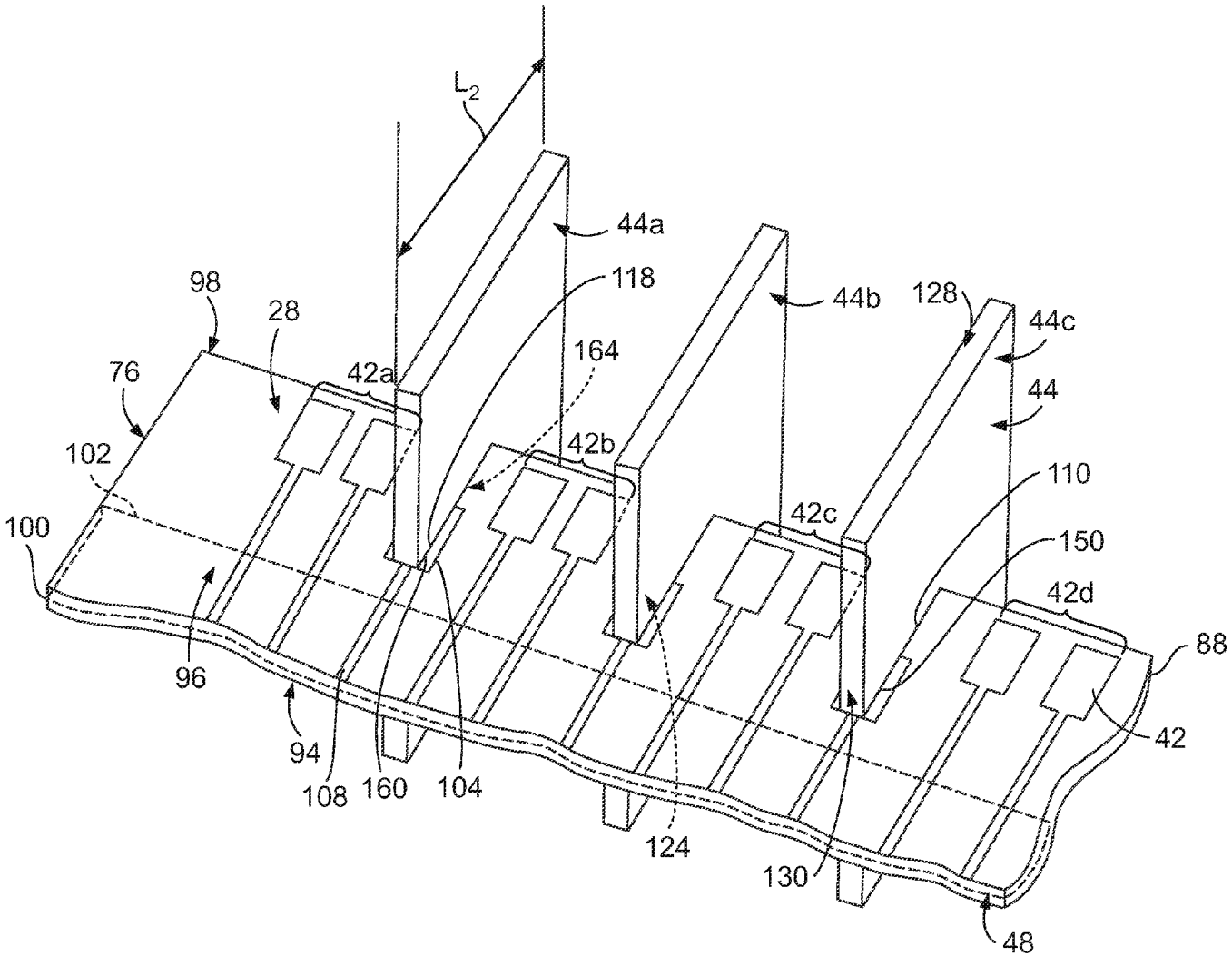
FIG. 7 is a perspective view of an exemplary embodiment of a plurality of the ground shields shown in FIG. 4 interlocked with the printed circuit shown in FIG. 3.

FIG. 3 is a perspective view of a portion of an exemplary embodiment of the mating edge 28 of the printed circuit 48. The printed circuit 48 includes a substrate 92 having a pair of opposite sides 94 and 96 and the edge surface 88, which intersects the sides 94 and 96. An end 98 (FIG. 7) of the edge surface 88 intersects an edge surface 100 (FIG. 7) of the edge 76 of the printed circuit 48. The mating edge 28 of the printed circuit 48 is defined by the edge surface 88 and portions of the sides 94 and 96 proximate the edge surface 88. The substrate 92 includes an optional ground plane 102. On the side 94, the mating edge 28 includes a plurality of the electrical contact pads 42 and a plurality of electrical ground contact pads 104. Electrical traces 106 electrically connect each of the contact pads 42 to one or more of the components 50 of the electronic module 30 and/or to one or more other components of, and/or mounted on, the printed circuit 48. Similarly, electrical traces 108 electrically connect each of the ground contact pads 104 to one or more grounds of the components 50 of the electronic module 30 and/or to one or more grounds of other components of, and/or mounted on, the printed circuit 48. For example, in some embodiments one or more of the electrical traces 108 electrically connects the corresponding ground contact pad 104 to a ground plane of the printed circuit, such as, but not limited to, the ground plane 102. Optionally, as in the exemplary embodiment, the side 96 of the printed circuit 48 includes contact pads 42, ground contact pads 104, electrical traces 106, and electrical traces 108 thereon, as can be seen in FIG. 7.

When the electronic module 30 is installed on the socket connector 10 (FIGS. 1, 2, 5, and 6) as shown in FIGS. 2 and 6, each of the contact pads 42 on the mating edge 28 of the printed circuit 48 engages, and thereby electrically connects to, the mating segment 38 (FIG. 5) of a corresponding one of the electrical contacts 34. As will be described below, each of the ground contact pads 104 engages, and thereby electrically connects to, one or more corresponding ones of the ground shields 44 (FIGS. 1, 4, 5, and 7).

In the exemplary embodiment, each of the contact pads 42 is a signal contact pad that transmits signals and the contact pads 42 are arranged in differential signal pairs. But, any number of the contact pads 42 may alternative be a ground contact pad that is connected to an electrical ground or an electrical power contact pad that transmits electrical power. In some alternative embodiments, one or more of the contact pads 42 is not arranged in a differential signal pair.

The mating edge 28 of the printed circuit 48 includes one or more slots 110 extending therein. As will be described below, each slot 110 receives a portion of a corresponding ground shield 44 therein when the electronic module 30 is installed on the socket connector 10. The slot 110 extends a length L into the mating edge 28 of the printed circuit 48 along a central longitudinal axis 112. The slot 110 extends into the mating edge 28 from an open end 114 to a bottom 116. Opposite side walls 118 and 120 of the printed circuit 48 that define the slot 110 extend the length L from the open end 114 to a bottom surface 122 of the bottom 116. In the exemplary embodiment, each slot 110 extends between two adjacent differential signal pairs of the contact pads 42.

The printed circuit 48 includes a board insertion area 124 extending proximate the bottom 116 of each of the slots 110. The board insertion areas 124 extend outwardly from the slot bottoms 116 toward an edge 126 (FIG. 2) of the printed circuit 48 that is opposite the mating edge 28. A portion of each of the ground contact pads 104 is located within a corresponding board insertion area 124. In the exemplary embodiment, each ground contact pad 104 extends between the electrical traces 106 of two adjacent differential signal pairs of the contact pads 42. As will be described below, when the electronic module 30 is installed on the socket connector 10, the board insertion areas 124 are received within the ground shields 44 and the ground contact pads 104 are engaged with the ground shields 44.

In the exemplary embodiment, each of the board insertion areas 124 includes a single ground contact pad 104, however, alternatively one or more of the board insertion areas 124 includes more than one ground contact pad 104. Each ground contact pad 104 may extend partially or completely within the corresponding board insertion area 124. The printed circuit 48 may include any number of the board insertion areas 124. In the exemplary embodiment, the length L of each the slots 110 extends approximately perpendicular relative to the edge surface 88. In other words, the central longitudinal axes 112 each extend approximately perpendicular to the edge surface 88. Alternatively, the length L, and thus the central longitudinal axis 112, of the one or more of the slots 110 extends at any other angle relative to the edge surface 88. The slots 110 may be arranged in any other pattern along the mating edge 28 than is shown and/or described herein. For example, one or more slots 110 may extend between two adjacent contact pads 42 wherein at least one of the two adjacent contact pads 42 does not form a part of a differential signal pair. Moreover, and for example, one or more of the slots 110 may have a different size relative to, and/or a different spacing from, the contact pads 42, the ground contact pads 104, the electrical traces 106, and/or the electrical traces 108 than is shown and/or described herein. The printed circuit 48 may include any number of the slots 110, and each slot 110 may receive any number of ground shields 44 therein. Each of the slots 110 may be referred to herein as a "board slot".

The side walls 118 and 120 and the bottom surface 122 are each defined by portions of the substrate 92 of the printed circuit 48 in the exemplary embodiment, such that the side walls 118 and 120 and the bottom surface 122 are not electrically conductive. Alternatively, the side walls 118 and/or 120 and/or the bottom surface 122 include one or more electrical conductors thereon and/or are partially defined by an electrical conductor. For example, in some alternative embodiments, the side walls 118 and 120 and the bottom surface 122 of the slots 110 are each defined by a portion of the ground plane 102, and/or an intermediary electrical conductor (not shown, such as but not limited to, an electrical trace) that is electrically connected to the ground plane 102, such that the ground shields 44 are engaged with, and electrically connected to, the ground plane 102 when the ground shields 44 are received within the slots 110. Moreover, and for example, in some alternative embodiments, the side walls 118 and/or 120 and/or the bottom surface 122 include one or more electrical conductors that extend from the walls 118 and/or 120 and/or the bottom surface 122 onto the side 94 and/or 96 of the printed circuit 48 to form electrical connections from the ground shields 44 to an electrical component, conductor, and/or the like on the side 94 and/or 96. In addition or alternative to being electrically connected to the ground plane 102 via the side walls 118 and/or 120 and/or the bottom surface 122, one or more of the ground shields 44 may be electrically connected to the ground plane 102 via engagement with a ground contact pad 104 that is electrically connected to the ground plane 102.

The contact pads 42, the ground contact pads 104, the electrical traces 106, the electrical traces 108, and the slots 110 may be arranged in any other relative pattern than is shown and/or described herein. For example, the contact pads 42, the ground contact pads 104, the electrical traces 106, the electrical traces 108, and/or the slots 110 may have any other pitches, geometric arrangement, and/or the like relative to each other than is shown and/or described herein. The printed circuit 48 may include any number of the contact pads 42, any number of the ground contact pads 104, any number of the electrical traces 106, any number of the electrical traces 108, and any number of the ground planes 102. In addition or alternative to the internal ground plane 102, the side 94 and/or the side 96 may include a ground plane thereon. Although in the exemplary embodiment each of the contact pads 42 and 104 is an electrically conductive pad, each contact pad 42 and 104 may include any other size, shape, geometry, and/or the like in addition or alternative to the approximately planar pad that is shown herein. One or more of the contact pads 42 may be referred to herein as a "signal contact" and/or as a "signal pad".

The substrate 92 of the printed circuit 48 may be a flexible substrate or a rigid substrate. The substrate 92 may be fabricated from and/or include any material(s), such as, but not limited to, ceramic, epoxy-glass, polyimide (such as, but not limited to, Kapton® and/or the like), organic material, plastic, polymer, and/or the like. In some embodiments, the substrate 92 is a rigid substrate fabricated from epoxy-glass, such that the printed circuit 48 is what is sometimes referred to as a "circuit board". In the exemplary embodiment, the substrate 92 includes only a single layer (the internal ground plane 102 not being considered a layer). Alternatively, the substrate 92 may include any number of layers greater than one layer. For example, the substrate 92 may include two exterior layers that each defines one of the sides 94 and 96, with one or more interior layers sandwiched between the exterior layers. Each interior layer of the substrate 92 may include electrical components and/or electrical conductors (such as, but not limited to, contacts, pads, traces, components, vias, ground planes, and/or the like) extending thereon and/or therethrough. Electrical components and/or conductors of interior layers of the substrate 92 may electrically connect some or all of the electrical components 50, pads 42, pads 104, traces 106, and/or traces 108 on the side 94 with one or more corresponding electrical components 50, pads 42, pads 104, traces 106, and/or traces 108 on the side 96, and/or vice versa. In addition or alternatively, electrical components and/or conductors of interior layers of the substrate 92 may electrically connect some or all of the electrical components 50, pads 42, pads 104, traces 106, and/or traces 108 on the side 94 and/or the side 96 to any other location on or within the substrate 92 (such as, but not limited to, any location on any layer, including the same layer, of the substrate 92).

Figure 4:
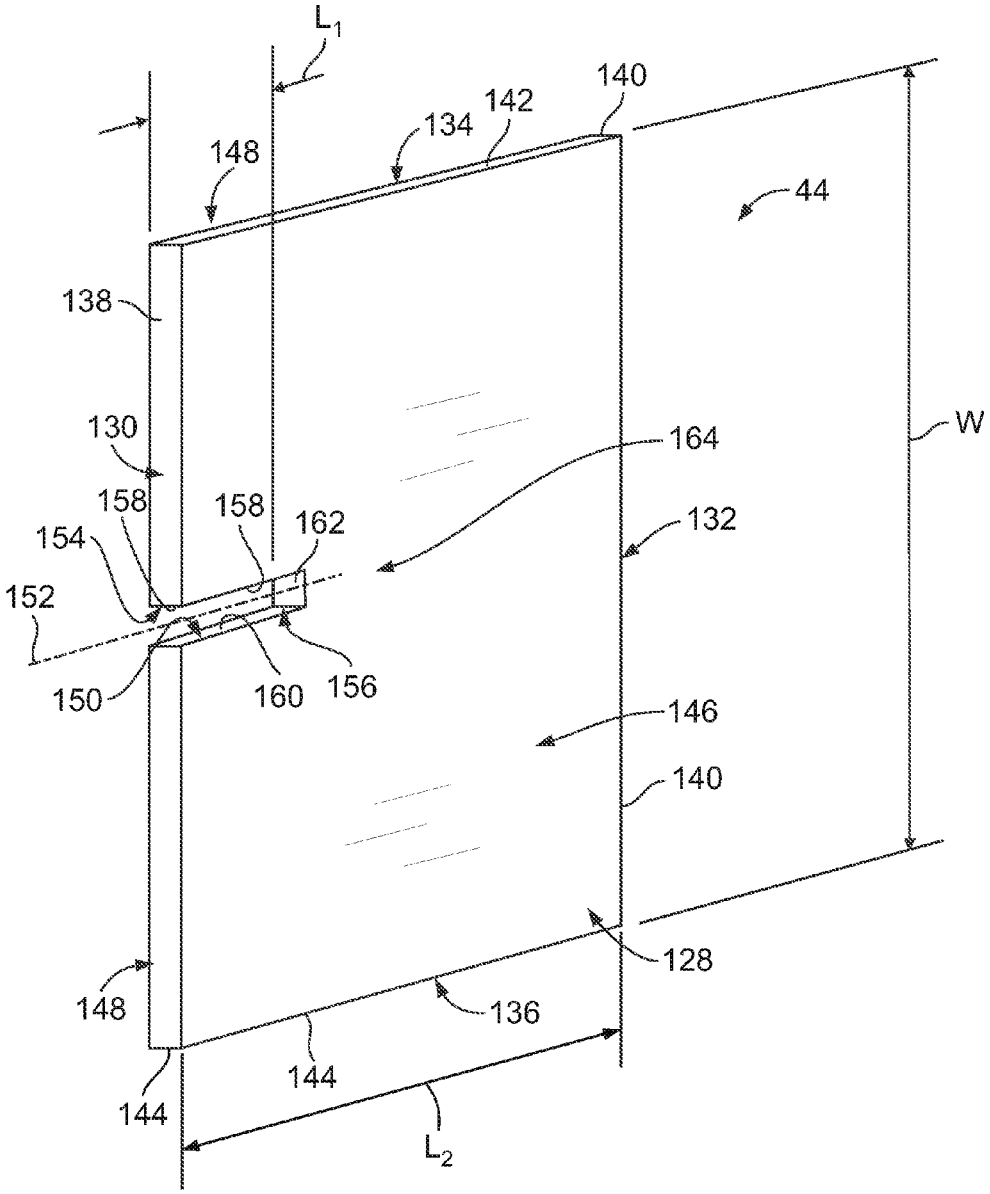
FIG. 4 is a perspective view of an exemplary embodiment of a ground shield of the socket connector shown in FIGS. 1 and 2.

FIG. 4 is a perspective view of an exemplary embodiment of a ground shield 44 of the socket connector 10 (FIGS. 1, 2, 5, and 6). The ground shield 44 includes a body 128 extending a length $L_2$ from a mating end 130 to a mounting end 132. The shield body 128 extends a width W from a side end 134 to an opposite side end 136. The mating end 130 includes a mating edge surface 138, the mounting end 132 includes a mounting edge surface 140, and the side ends 134 and 136 includes respective edge surfaces 142 and 144. Opposite sides 146 and 148 of the body 128 extend the width of the body 128 from the edge surface 142 to the edge surface 144, and extend the length of the body from the mating edge surface 138 to the mounting edge surface 140. In the exemplary embodiment, the body 128 of the ground shield 44 is fabricated completely from one or more electrically conductive materials. Alternatively, only a portion of the body 128 of the ground shield 44 is electrically conductive. For example, in some alternative embodiments, the body 128 of the ground shield 44 is fabricated from one or more electrically insulating materials (such as, but not limited to, a plastic) that is at least partially plated with one or more electrically conductive material.

The mating end 130 of the ground shield 44 includes one or more slots 150 extending therein. As will be described below, the slot 150 receives a portion of the mating edge 28 (FIGS. 2, 3, 6, and 7) of the printed circuit 48 (FIGS. 2, 3, 6, and 7) therein when the electronic module 30 (FIGS. 2 and 6) is installed on the socket connector 10. The slot 150 extends a length $L_1$ into the mating end 130 of the shield body 128 along a central longitudinal axis 152. The slot 150 extends into the mating end 130 from an open end 154 to a bottom 156. Opposite side walls 158 and 160 of the shield body 128 that define the slot 150 extend the length $L_1$ from the open end 154 to a bottom surface 162 of the bottom 156. The side walls 158 and 160 may each be referred to herein as a "slot surface".

The ground shield 44 includes a shield insertion area 164 extending proximate the bottom 156 of the slots 150. The shield insertion area 164 extends outwardly from the slot bottom 156 toward the mounting end 132 of the shield body 128. As will be described below, when the electronic module 30 is installed on the socket connector 10, the shield insertion area 164 is received within a corresponding slot 110 (FIGS. 3 and 7) of the printed circuit 48 and at least one of the side walls 158 and 160 is engaged with a corresponding ground contact pad 104 (FIGS. 3 and 7) of the printed circuit 48.

The ground shield 44 may include any number of the shield insertion areas 164. In the exemplary embodiment, the length $L_1$ of the slot 150 extends approximately perpendicular relative to the mating edge surface 138 of the mating end 130. In other words, the central longitudinal axis 152 extends approximately perpendicular to the mating edge surface 138. Alternatively, the length $L_1$, and thus the central longitudinal axis 152, of the one or more of the slots 150 extends at any other angle relative to the mating edge surface 138. One or more slots 150 may be arranged in any other pattern along the mating end 130 than is shown and/or described herein. The shield body 128 may include any number of the slots 150, and each slot 150 may receive any number of mating edges 28. In the exemplary embodiment, the shield body 128 includes an approximately rectangular shape. But, the shield body 128 may additionally or alternatively include any other shapes, such as, but not limited to, triangular, circular, hexagonal, an oval shape, and/or the like.

Figure 5:
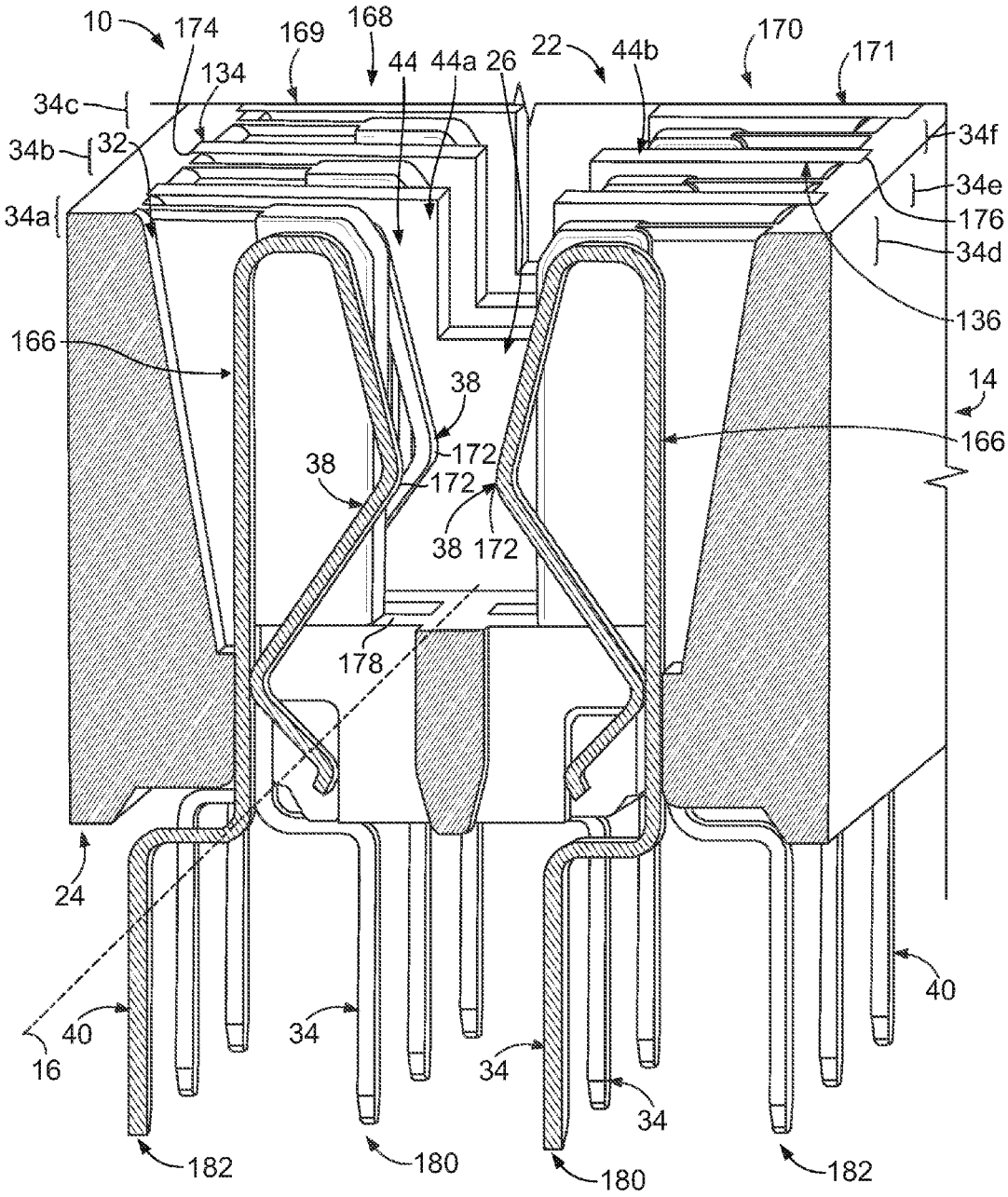
FIG. 5 is a perspective view of a cross section of the socket connector shown in FIGS. 1 and 2.
Figure 6:
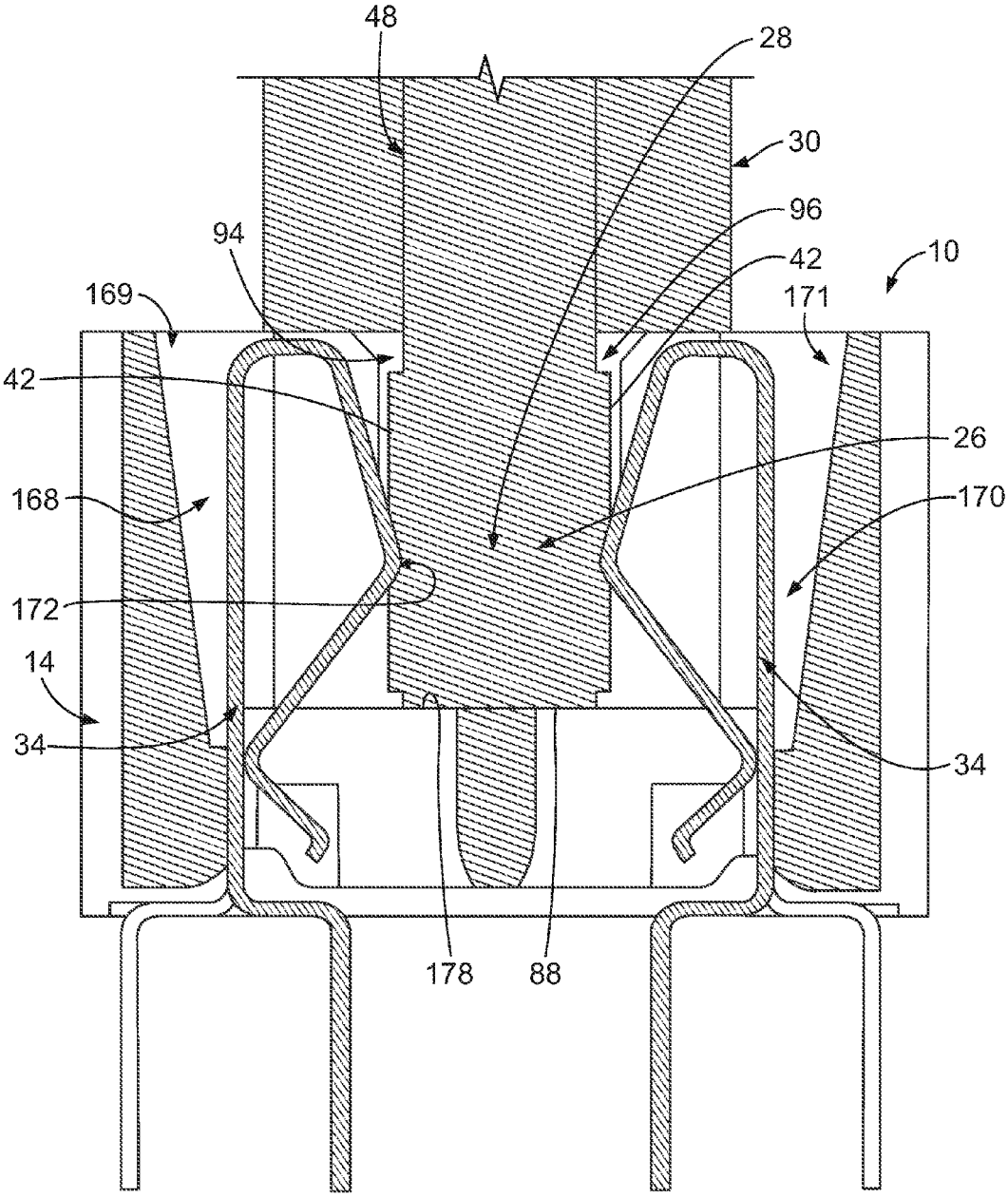
FIG. 6 is a cross sectional view of the socket connector and electronic module shown in FIG. 2 taken along line 6-6 of FIG. 2.

FIG. 5 is a perspective view of a cross section of the socket connector 10. Each electrical contact 34 includes the mating segment 38, the mounting segment 40, and an intermediate segment 166 that extends between the mating and mounting segments 38 and 40, respectively. Each electrical contact 34 is held by the housing body 14 within the corresponding opening 32 such that the mating segment 38 extends into the socket 26. In the exemplary embodiment, the electrical contacts 34 are arranged in a pair of opposite rows 168 and 170 extending along opposite sides 169 and 171, respectively, of the socket 26. Mating interfaces 172 of the mating segments 38 of the electrical contacts 34 are thereby arranged within the rows 168 and 170. The mating interfaces 172 of the electrical contacts 34 within the row 168 face the mating interfaces 172 of the opposing electrical contacts 34 within the opposite row 170. In the exemplary embodiment, each of the electrical contacts 34 is a signal contact that transmits signals. But, any number of the electrical contacts 34 may alternatively be a ground contact that is connected to an electrical ground or an electrical power contact that transmits electrical power. The electrical contacts 34 are arranged in differential signal pairs in the exemplary embodiment. Specifically, as can be seen in FIG. 5, adjacent electrical contacts 34 within the row 168 are arranged in differential signal pairs 34*a*, 34*b*, and 34*c*, while adjacent electrical contacts 34 within the row 170 are arranged in differential signal pairs 34*d*, 34*e*, and 34*f*. In some alternative embodiments, one or more of the electrical contacts 34 is not arranged in a differential signal pair. Moreover, in some alternative embodiments, an electrical contact 34 within the row 168 is arranged in a differential signal pair with an electrical contact 34 within the row 170.

The ground shields 44 are held by the housing body 14 within the openings 32. In the exemplary embodiment, the side ends 134 and 136 of each ground shield 44 are received within respective slots 174 and 176 of the housing body 14, and the shield body 128 has a press (or interference) fit with the housing body 14 to hold the ground shield 44 therein. The mounting ends 132 of the ground shields 44 optionally abut a shoulder 178 of the housing body 14. In addition or alternative to the slots 174 and/or 176, and/or the press (or interference) fit, each ground shield 44 may be held within the corresponding opening 32 by any other structure, means, and/or the like. Examples of other structures, means, and/or the like for holding the grounds shields 44 within the openings 32 include adhesive, latches, a snap-fit, fasteners, and/or the like.

In the exemplary embodiment, each ground shield 44 extends between adjacent differential signal pairs of the electrical contacts 34. For example, the ground shield 44*a* extends between the adjacent differential signal pairs 34*a* and 34*b* and between the adjacent differential signal pairs 34*d* and 34*e*. The ground shield 44*b* extends between the adjacent differential signal pairs 34*b* and 34*c* and between the adjacent differential signal pairs 34*e* and 34*f*. Moreover, in the exemplary embodiment, each ground shield 44 extends across the entirety of the corresponding opening 32, such that the ground shield 44 extends between two different sets of adjacent differential signal pairs of the electrical contacts 34 that are within different rows. For example, the ground shield 44*a* extends between the adjacent differential signal pairs 34*a* and 34*b* within the row 168, and between the pairs 34*d* and 34*e* within the row 170. But, each ground shield 44 may extend between any two adjacent electrical contacts 34, whether or not the two adjacent contacts 34 form part of two adjacent differential signal pairs and whether or not the ground shield 44 extends between two different sets of adjacent differential signal pairs that are within different rows. For example, one or more ground shields 44 may extend between two adjacent electrical contacts 34 wherein at least one of the two adjacent contacts 34 does not form a part of a differential signal pair. Moreover, and for example, one or more of the ground shields 44 may extend across only a portion the corresponding opening 32 such that the ground shield 44 only extends between two adjacent electrical contacts 34 within the same row 168 or the row 170. In the exemplary embodiment, the width W (FIG. 4) of the shield body 128 of each of the ground shields 44 extends approximately perpendicular to the mating interfaces 172 of the electrical contacts 34 that are adjacent thereto. Alternatively, the width W of the shield body 128 of one or more of the ground shields 44 extends at any other non-parallel angle relative to the mating interfaces 172 of one or more adjacent electrical contacts 34.

The socket connector 10 may include any number of the ground shields 44. Any number of the ground shields 44 may include a shield slot 150 for interlocking with the printed circuit 48. The socket connector 10 may include any number of the electrical contacts 34, one or more of which may be referred to herein as a "signal contact". Although two rows 168 and 170 are shown, the socket connector 10 alternatively only includes one of the rows 168 or 170 of the electrical contacts 34.

As can be seen in FIG. 5, the mounting segment 40 of each of the electrical contacts 34 is optionally offset from the mounting segment 40 of each adjacent contact 34 within the same row 168 or 170 to form inner and outer rows 180 and 182, respectively, thereof. In the exemplary embodiment, the mounting segments 40 of the electrical contacts are configured as solder tails. However, the mounting segments 40 are not limited to being solder tails, but rather may have any suitable arrangement, configuration, structure, geometry, and/or the like that enables the mounting segments to electrically connected to a printed circuit and/or another electrical component, such as, but not limited to, using a press-fit arrangement, a surface mount arrangement, and/or the like.

FIG. 6 is a cross sectional view of the socket connector 10 and electronic module 30 taken along line 6-6 of FIG. 2. When the electronic module 30 is installed on the socket connector 10, the mating edge 28 of the printed circuit 48 of the electronic module 30 is received within the socket 26 of the socket connector 10. Each contact pad 42 on the side 94 of the printed circuit 48 is engaged with the mating interface 172 of the corresponding electrical contact 34 within the row 168 to electrically connect the contact pad 42 to the electrical contact 34. Similarly, each contact pad 42 on the side 96 of the printed circuit 48 is engaged with the mating interface 172 of the corresponding electrical contact 34 within the row 170. Optionally, the edge surface 88 of the mating edge 28 of the electronic module 30 abuts the shoulder 178 of the housing body 14 when the electronic module 30 is installed on the socket connector 10.

FIG. 7 is a perspective view of an exemplary embodiment of a plurality of the ground shields 44 interlocked with the printed circuit 48. FIG. 7 represents the condition of the mating edge 28 of the printed circuit 48 and the ground shields 44 when the electronic module 30 (FIGS. 2 and 6) is installed on the socket connector 10 (FIGS. 1, 2, 5, and 6). The mating edge 28 of the printed circuit 48 is received within the slot 150 of each of the ground shields 44. Similarly, each of the ground shields 44 is received within a corresponding one of the slots 110 within the mating edge 28 of the printed circuit 48. Specifically, each board insertion area 124 of the printed circuit 48 is received within the slot 150 of a corresponding one of the ground shields 44, and the shield insertion area 164 of each of the ground shields 44 is received within a corresponding one of the slots 110 of the printed circuit 48. The mating edge 28 of the printed circuit 48 and the mating ends 130 of the ground shields 44 are thereby interlocked. In other words, the slot 150 of each ground shield 44 is interlocked with a corresponding one of the slots 110 of the printed circuit 48. For each pair of interlocked slots 110 and 150, the bottom surfaces 122 and 162 (FIGS. 3 and 4, respectively) optionally abut each other.

When the ground shields 44 are interlocked with the printed circuit 48 as shown in FIG. 7, the shield body 128 of each of the ground shields 44 is electrically connected to the printed circuit 48. Specifically, in the exemplary embodiment, the side wall 160 of the slot 150 of each of the ground shields 44 engages a corresponding one of the ground contact pads 104 on the side 96 of the printed circuit 48, as can be seen in FIG. 7. Although not visible in FIGS. 7, in the exemplary embodiment, the side wall 158 (FIG. 4) of the slot 150 of each of the ground shields 44 engages a corresponding one of the ground contact pads 104 on the side 94 of the printed circuit 48. In some alternative embodiments, the side wall 158 and/or the side wall 160 engages more than one ground contact pad 104 on the respective side 94 and 96 of the printed circuit 48. Moreover, one or more of the ground shields 44 may engage a ground contact pad 104 on only one side 94 or 96 of the printed circuit 48.

Engagement between the side walls 158 and 160 and the corresponding ground contact pads 104 electrically connects the ground shields 44 to the ground contact pads 104 and thereby to the printed circuit 48. In some embodiments, one or more of the ground shields 44 is electrically connected to the ground plane 102 and/or one or more other ground planes of the printed circuit 48. For example, in some embodiments one or more of the electrical traces 108 electrically connects the corresponding ground shield 44 to the ground plane 102. In addition or alternatively, one or more of the grounds shields 44 is electrically connected to the ground plane via engagement with the ground plane 102 or an intermediary conductor through the side walls 118 and/or 120 and/or the bottom surface 122 of the corresponding slot 110 of the printed circuit 48. One or more of the ground contact pads 104 may be considered to define a ground plane of the printed circuit 48. The body 128 of one or more of the ground shields 44 may be considered to define a ground plane. In some embodiments, the electrical connection between the ground shields 44 and the ground plane 102 and/or the ground contact pads 104 forms an inter-locking ground shield lattice. Because the widths W of the shield bodies 128 extend approximately perpendicular to the sides 94 and 96 of the printed circuit 48 in the exemplary embodiment, the electrical connection between the ground shields 44 and the ground contact pads 104 and/or the ground plane 102 forms a network of vertical and horizontal ground planes.

In the exemplary embodiment, the shield insertion area 164 of each ground shield 44 extends between adjacent differential signal pairs of the contact pads 42. For example, the ground shield 44*a* extends between the adjacent differential signal pairs 42*a* and 42*b*, the ground shield 44*b* extends between the adjacent differential signal pairs 42*b* and 42*c*, and the ground shield 44*c* extends between the adjacent differential signal pairs 42*c* and 42*d*. But, each ground shield 44 may extend between any two adjacent contacts pads 42, whether or not the two adjacent contact pads 42 form part of two adjacent differential signal pairs In the exemplary embodiment, the width W (FIG. 4) of the shield body 128 of each of the ground shields 44 extends approximately perpendicular to the printed circuit 48. Specifically, the width W of the shield body 128 extends approximately perpendicular to the sides 94 and 96 of the printed circuit 48. Alternatively, the width W of the shield body 128 of one or more of the ground shields 44 extends at any other non-parallel angle relative to the sides 94 and/or 96 of the printed circuit 48. Moreover, although the length $L_2$ of each of the shield bodies 128 extends approximately perpendicular to the edge surface 88 of the printed circuit 48, the length $L_2$ of one or more of the shield bodies 128 may extend at any other non-parallel angle relative to the edge surface 88.

Figure 8:
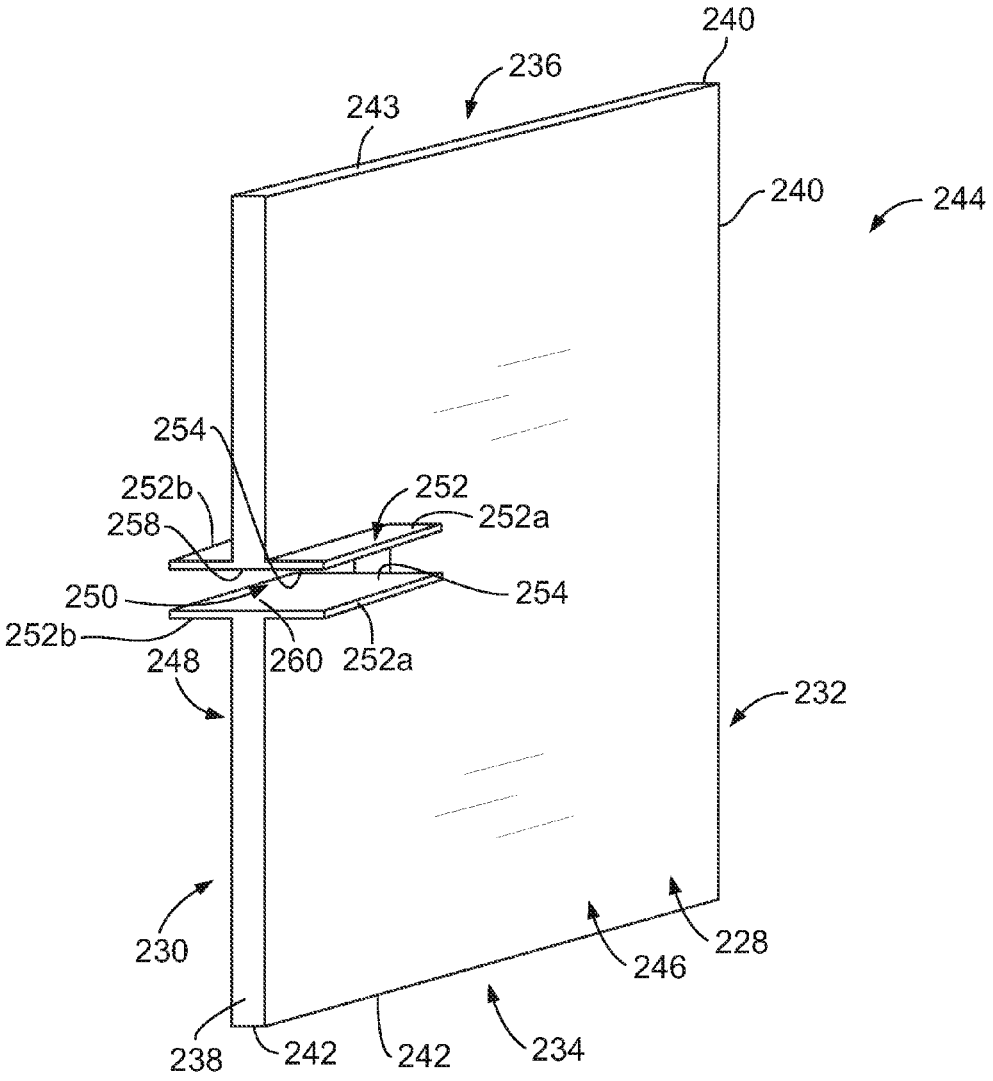
FIG. 8 is a perspective view of an exemplary alternative embodiment of a ground shield of the socket connector shown in FIGS. 1 and 2.

FIG. 8 is a perspective view of an exemplary alternative embodiment of a ground shield 244 of the socket connector 10 (FIGS. 1, 2, 5, and 6). The ground shield 244 includes an electrically conductive body 228 extending a length from a mating end 230 to a mounting end 232. The shield body 228 extends a width from a side end 234 to an opposite side end 236. The mating end 230 includes a mating edge surface 238, the mounting end 232 includes a mounting edge surface 240, and the side ends 234 and 236 includes respective edge surfaces 242 and 243. Opposite sides 246 and 248 of the body 228 extend the width of the body 228 from the edge surface 242 to the edge surface 243, and extend the length of the body from the mating edge surface 238 to the mounting edge surface 240.

The mating end 230 of the ground shield 244 includes one or more slots 250 extending therein. The slot 250 includes opposite side walls 258 and 260. The slot 250 receives a portion of the mating edge 28 (FIGS. 2, 3, 6, and 7) of the printed circuit 48 (FIGS. 2, 3, 6, and 7) therein when the electronic module 30 (FIGS. 2 and 6) is installed on the socket connector 10. The slot 250 is substantially similar to the slot 150 (FIGS. 4 and 7) and therefore will not be described in more detail herein.

The ground shield 244 includes one or more electrical contacts 252 extending from the shield body 228. Specifically, in the exemplary embodiment, the ground shield 244 includes two electrical contacts 252*a* that extend outward from the side 246 of the shield body 228, and two electrical contacts 252*b* that extend outward from the side 248 of the shield body 228. Each of the electrical contacts 252 extends outwardly proximate the slot 250 and includes a mating surface 254. In addition or alternative to the engagement between the side walls 258 and/or 260 of the slot 250 and the corresponding ground contact pads 104 (FIGS. 3 and 7) of the printed circuit 48, each of the mating surfaces 254 of the electrical contacts 252 engages one or more corresponding ground contact pads 104 (whether or not the same pad(s) 104 as the side walls 258 and/or 260) to electrically connect the ground shield 244 to the printed circuit 48.

Although four are shown, the ground shield 244 may include any number of the electrical contacts 252. Moreover, each side 246 and 248 of the shield body 228 may include any number of the electrical contacts 252 extending outwardly therefrom. Optionally, one or more of the electrical contacts 252 is formed integrally with the shield body 228. Each electrical contact 252 may include any other shape than is shown herein.

The embodiments described and/or illustrated herein may provide an electrical connector having a reduced amount of crosstalk, interference, noise, and/or the like, and/or an improved signal performance, than at least some known electrical connectors.

It is to be understood that the above description and the figures are intended to be illustrative, and not restrictive. For example, the above-described and/or illustrated embodiments (and/or aspects thereof) may be used in combination with each other. In addition, many modifications may be made to adapt a particular situation or material to the teachings of the subject matter described and/or illustrated herein without departing from its scope. Dimensions, types of materials, orientations of the various components (including the terms "upper", "lower", "vertical", and "lateral"), and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description and the figures. The scope of the subject matter described and/or illustrated herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A socket connector assembly comprising:

a printed circuit having a mating edge;

a housing comprising a socket, the socket receiving the mating edge of the printed circuit therein;

signal contacts held by the housing, the signal contacts comprising mating interfaces arranged in a row within the socket of the housing; and electrically conductive ground shields held by the housing, the ground shields extending from mating ends to mounting ends, the mating ends of the ground shields extending between adjacent signal contacts, the ground shields comprising shield slots extending into the mating ends, the shield slots of the ground shields receiving the mating edge of the printed circuit therein to electrically connect the ground shields to the printed circuit.

2. The socket connector assembly according to claim 1, wherein the signal contacts are arranged in differential signal pairs, the ground shields extending between adjacent differential signal pairs of the signal contacts.

3. The socket connector assembly according to claim 1, wherein the socket of the housing comprises opposing sides, the signal contacts being arranged in opposing rows that extend along the opposing sides of the socket, at least one of the ground shields extending within the socket of the housing between corresponding adjacent signal contacts within both of the opposing rows of the signal contacts.

4. The socket connector assembly according to claim 1, wherein a width of at least one of the ground shields extends non-parallel to the mating interface of at least one of the signal contacts.

5. The socket connector assembly according to claim 1, wherein the shield slots of the ground shields are configured to interlock with board slots that extend into the mating edge of the printed circuit.

6. The socket connector assembly according to claim 1, wherein the ground shields comprise opposite side walls that define side boundaries of the shield slots, at least one of the side walls of at least one of the ground shields being engaged with a ground contact of the printed circuit when the mating edge of the printed circuit is received within the shield slots.

7. The socket connector assembly according to claim 1, wherein the printed circuit has a side that includes signal contact pads arranged thereon and ground contact pads thereon, the mating interfaces of the signal contacts of the socket connector being engaged with the signal contact pads when the mating edge of the printed circuit is received within the socket, the ground shields engaged with the ground contact pads when the mating edge of the printed circuit is received within the socket.

8. The socket connector assembly according to claim 1, wherein the ground shields are electrically connected to the printed circuit at generally rigid side walls of the ground shields.

9. An electrical connector assembly comprising:

a mating connector;

a printed circuit having a side that extends from a mating edge to an opposite edge, the side comprising signal contacts arranged along the mating edge, the side of the printed circuit being configured to mate with the mating connector at the mating edge, the printed circuit comprising a board slot extending a length into the mating edge, the board slot extending between adjacent signal contacts; and the mating connector comprising an electrically conductive ground shield extending from a mating end to a mounting end, the mating end being received within the board slot, the ground shield comprising a shield slot extending into the mating end, the shield slot of the ground shield being interlocked with the board slot of the printed circuit such that the ground shield is received within the board slot and the printed circuit is received within the shield slot.

10. The assembly according to claim 9, wherein the ground shield comprises a slot surface that defines a portion of the shield slot, the side of the printed circuit comprising a ground contact engaged with the slot surface to electrically connect the ground shield to the ground contact.

11. The assembly according to claim 9, wherein the signal contacts are arranged in differential signal pairs, the board slot extending between adjacent differential signal pairs of the signal contacts, the ground shield comprising an insertion area that is received with the board slot of the printed circuit such that the insertion area extends between the adjacent differential signal pairs of the signal contacts.

12. The assembly according to claim 9, wherein the board slot comprises board slots and the ground shield comprises ground shields, the printed circuit comprising at least one ground plane, the ground shields being electrically connected to the at least one ground plane such that the ground plane and the ground shields form an inter-locking ground shield lattice.

13. The assembly according to claim 9, wherein the board slot comprises board slots and the ground shield comprises ground shields, the printed circuit comprising ground contacts, the ground shields being electrically connected to corresponding ones of the ground contacts, the ground shields extending approximately perpendicular to the printed circuit such that the ground shields and the ground contacts form a network of vertical and horizontal ground planes.

14. The assembly according to claim 9, wherein the board slot extends a length into the printed circuit to a board slot bottom, the printed circuit comprising a board insertion area extending proximate the board slot bottom, the shield slot extending into the ground shield to a shield slot bottom, the ground shield comprising a shield insertion area proximate the shield slot bottom, the board insertion area being received within the shield slot, the shield insertion area being received within the board slot.

15. The assembly according to claim 9, wherein the ground shield is electrically connected to the printed circuit at a generally rigid side wall of the ground shield.

16. An electrical connector assembly comprising:

a socket connector comprising:

a housing comprising a socket;

signal contacts held by the housing, the signal contacts comprising mating interfaces arranged in a row within the socket of the housing; and electrically conductive ground shields held by the housing, the ground shields extending from mating ends to mounting ends, the mating ends of the ground shields extending between adjacent signal contacts, the ground shields comprising shield slots extending into the mating ends; and a mating connector comprising a printed circuit having a side that extends from a mating edge to an opposite edge, the side comprising signal pads arranged along the mating edge, the printed circuit comprising a board slot extending a length into the mating edge, the board slot extending between adjacent signal pads, wherein the mating edge of the printed circuit is received within the socket of the housing and the ground shields are interlocked with the board slots of the printed circuit such that the ground shields are received within the board slots and the printed circuit is received within the shield slots.

17. The assembly according to claim 16, wherein the signal pads of the printed circuit are arranged in differential signal pairs, the ground shields comprising insertion areas that are received with corresponding ones of the board slots of the printed circuit such that the insertion areas extends between the corresponding adjacent differential signal pairs of the signal pads.

18. The assembly according to claim 16, wherein the printed circuit comprises at least one ground plane, the ground shields being electrically connected to the at least one ground plane.

19. The assembly according to claim 16, wherein the side of the printed circuit comprises ground pads arranged thereon, the mating interfaces of the signal contacts of the socket connector being engaged with the signal pads, the ground shields being engaged the ground contact pads.

20. The assembly according to claim 16, wherein the ground shields are electrically connected to the printed circuit of the mating connector at generally rigid side walls of the ground shields.

* * * * *